US007669905B1

(12) United States Patent
Kondo

(10) Patent No.: US 7,669,905 B1
(45) Date of Patent: Mar. 2, 2010

(54) REAR SUSPENSION CARRIER DEVICE AND METHOD OF USE THEREOF

(75) Inventor: Tetsuji Kondo, Birmingham, AL (US)

(73) Assignee: Honda Motor Co., Ltd., Tokyo (JP)

( * ) Notice: Subject to any disclaimer, the term of this patent is extended or adjusted under 35 U.S.C. 154(b) by 186 days.

(21) Appl. No.: 11/775,623

(22) Filed: Jul. 10, 2007

(51) Int. Cl.
*B66C 1/54* (2006.01)

(52) U.S. Cl. ..... 294/97; 294/117

(58) Field of Classification Search ..... 294/16, 294/117, 118, 62, 89, 93, 97, 158
See application file for complete search history.

(56) References Cited

U.S. PATENT DOCUMENTS

| | | | | | |
|---|---|---|---|---|---|
| 264,547 | A | * | 9/1882 | McCosh | 294/16 |
| 2,558,114 | A | * | 6/1951 | Williams et al. | 294/97 |
| 2,832,633 | A | * | 4/1958 | Compson | 294/97 |
| 3,310,337 | A | * | 3/1967 | Riemenschneider | 294/97 |
| 4,206,898 | A | | 6/1980 | Salter | |
| 4,293,156 | A | | 10/1981 | Chapalain | |
| 4,300,382 | A | * | 11/1981 | Meek | 72/478 |
| 4,372,016 | A | | 2/1983 | LaViolette et al. | |
| 4,576,407 | A | * | 3/1986 | Lambert | 294/97 |
| 5,002,176 | A | | 3/1991 | Lotzer et al. | |
| 5,727,834 | A | | 3/1998 | Weselowski | |
| 6,609,742 | B1 | | 8/2003 | Macom et al. | |
| 7,007,992 | B2 | * | 3/2006 | Young | 294/97 |
| 7,130,135 | B2 | | 10/2006 | Shimizu | |

* cited by examiner

*Primary Examiner*—Dean J Kramer
(74) *Attorney, Agent, or Firm*—Standley Law Group LLP

(57) ABSTRACT

A carrier device for facilitating the suspended support of a vehicle rear suspension assembly. The device includes a pair of rotatably coupled members having support legs that are adapted to pass at least partially through an existing opening in the vehicle rear suspension assembly. Projections extending from the support legs subsequently engage the vehicle rear suspension assembly structure adjacent the opening, thereby providing support for the vehicle rear suspension assembly once suspended. A suspension element such as a cable or chain is coupled to the device and to a lifting mechanism, overhead conveyor, etc., for suspending the vehicle rear suspension assembly.

10 Claims, 9 Drawing Sheets

REAR SUSPENSION CARRIER DEVICE AND METHOD OF USE THEREOF

BACKGROUND OF THE INVENTIVE FIELD

The present invention is directed to a carrier device that can be used to suspend and transport a vehicle rear suspension assembly, such as along an assembly line. More particularly, the present invention is directed to a carrier device that can be used to suspend and transport a vehicle rear suspension assembly by passing through a hole present therein and subsequently engaging a portion of said suspension assembly structure.

As would be understood by one of skill in the art, manufacturing processes commonly require the transport of various components, or component assemblies, about an assembly area or along an assembly line. When such components/assemblies are of small size and/or weight, it is often possible to accomplish such transport by hand or by simplistic conveying means. However, when such components/assemblies are large, heavy and/or of irregular shape, their transport through a manufacturing process can be more difficult.

It is also often necessary to suspend or otherwise support in location a component/assembly while another component or assembly is attached thereto, or while the component/assembly is attached to some other component or structure. As with the process of transporting large, heavy and/or irregularly shaped components/assemblies, it can be understood that supporting the same during a manufacturing operation can also be difficult.

A vehicle rear suspension assembly is exemplary of a component/assembly that is difficult to transport or support in position. As would be understood by one skilled in the art, a vehicle rear suspension assembly may include a number of connected individual components that collectively result in a heavy, irregularly shaped, and often unbalanced assembly. As such, the hanging of a vehicle rear suspension assembly from an overhead conveying mechanism has been a commonly employed transport and/or suspension technique. More particularly, a coupling element is attached to the overhead conveyor and a number of lengths of chain are extended therefrom and connected to various points about the rear suspension assembly.

It can be easily recognized that such a transport and/or support technique is undesirable for a number of reasons. First, such a technique requires the use of a number of (often unequal) lengths of chain and numerous corresponding connectors for each rear suspension assembly to be transported and/or supported. Further, the connection of each length of chain to a corresponding point on the rear suspension assembly, and the subsequent disconnection thereof, is time consuming and must be done with proper skill.

Therefore, it can be understood that a more efficient technique for safely and satisfactorily transporting/supporting a vehicle rear suspension assembly would be desirable. Embodiments of a device and method of the present invention facilitate such transport/support.

SUMMARY OF THE GENERAL INVENTIVE CONCEPT

Generally, the present invention comprises a carrier device that can be partially passed through an existing opening in a vehicle rear suspension assembly to facilitate the transport and/or hanging support thereof, such as from an overhead conveyor or the like. At least one embodiment of the present invention includes a first and second member, each having an elongate support leg, and coupled together in rotatable scissor-like arrangement. One or both of the members preferably has an opening or other structure at one end thereof for receiving a lifting hook or similar connector after the members have been coupled. Preferably, but not necessarily, each member also has a handle extending at some angle therefrom to facilitate manipulation and use of the device.

The support legs are of a size that allows their coupled passage through the aforementioned opening in the vehicle rear suspension assembly. At least one, and preferably both, of the legs includes a projection at or near a distal end thereof. The projections act essentially as hooks that, after exiting said existing opening, engage the vehicle rear suspension assembly along the perimeter of the opening. The vehicle rear suspension assembly is thus supported/carried on said projections.

The rotatably coupled arrangement of the members is also preferably biased, such as by a spring, so that the projections on each leg are urged away from one another. In this manner, it can be better ensured that the projections will overlap the structure of the vehicle rear suspension assembly surrounding the opening therein once the projections exit therefrom. Preferably, the outward biasing of the legs and their projections can be temporarily overcome by a user of the device so as to facilitate passage of the legs of the device through the opening in the vehicle rear suspension assembly. This may be accomplished, for example, by squeezing the handles extending from the legs, or by manipulating the legs themselves. This and other features of a device of the present invention will be better understood upon a reading of the remainder of the present specification, preferably with reference to the accompanying drawing figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1C:
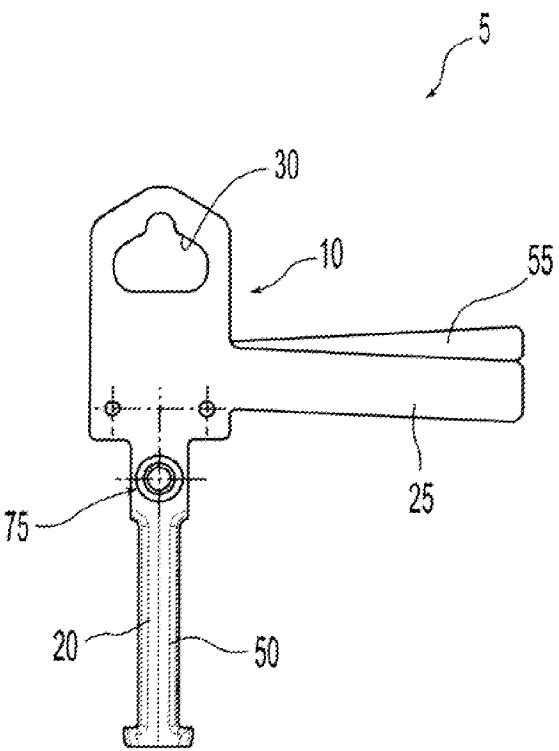
FIG. 1*c* is a left side elevation view of the carrier device of FIGS. 1*a*-1*b;*
Figure 1B:
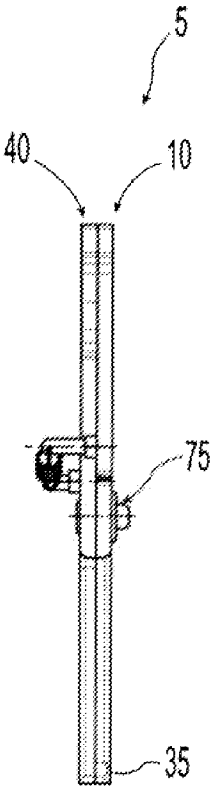
FIG. 1*b* is a front elevation view of the carrier device of FIG. 1*a;*
Figure 1A:
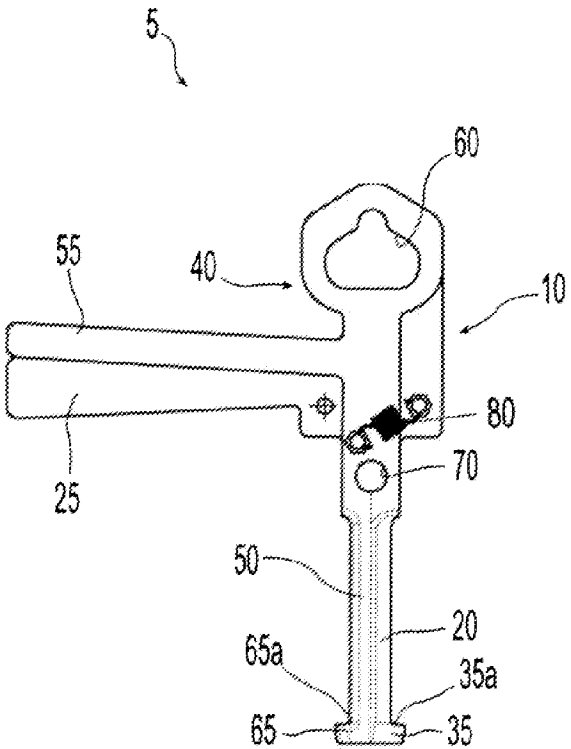
FIG. 1*a* is a right side elevation view of one embodiment of a vehicle rear suspension carrier device of the present invention.

One exemplary embodiment of a vehicle rear suspension assembly carrier device (hereinafter, carrier device) 5 of the present invention is shown in FIGS. 1*a*-1*c*. Basically, the carrier device 5 is comprised of two separate members 10, 40 that are rotatably coupled in a scissor-like arrangement. A portion of the carrier device 5 is designed to pass through an existing hole H of a vehicle rear suspension assembly A.

As can be observed in FIGS. 1*a*-3*b*, each member 10, 40 of this embodiment of the carrier device 5 is essentially manufactured from a flat sheet of material. Other embodiments may have contours if desired, but such is not necessary to the invention.

Figure 2A:
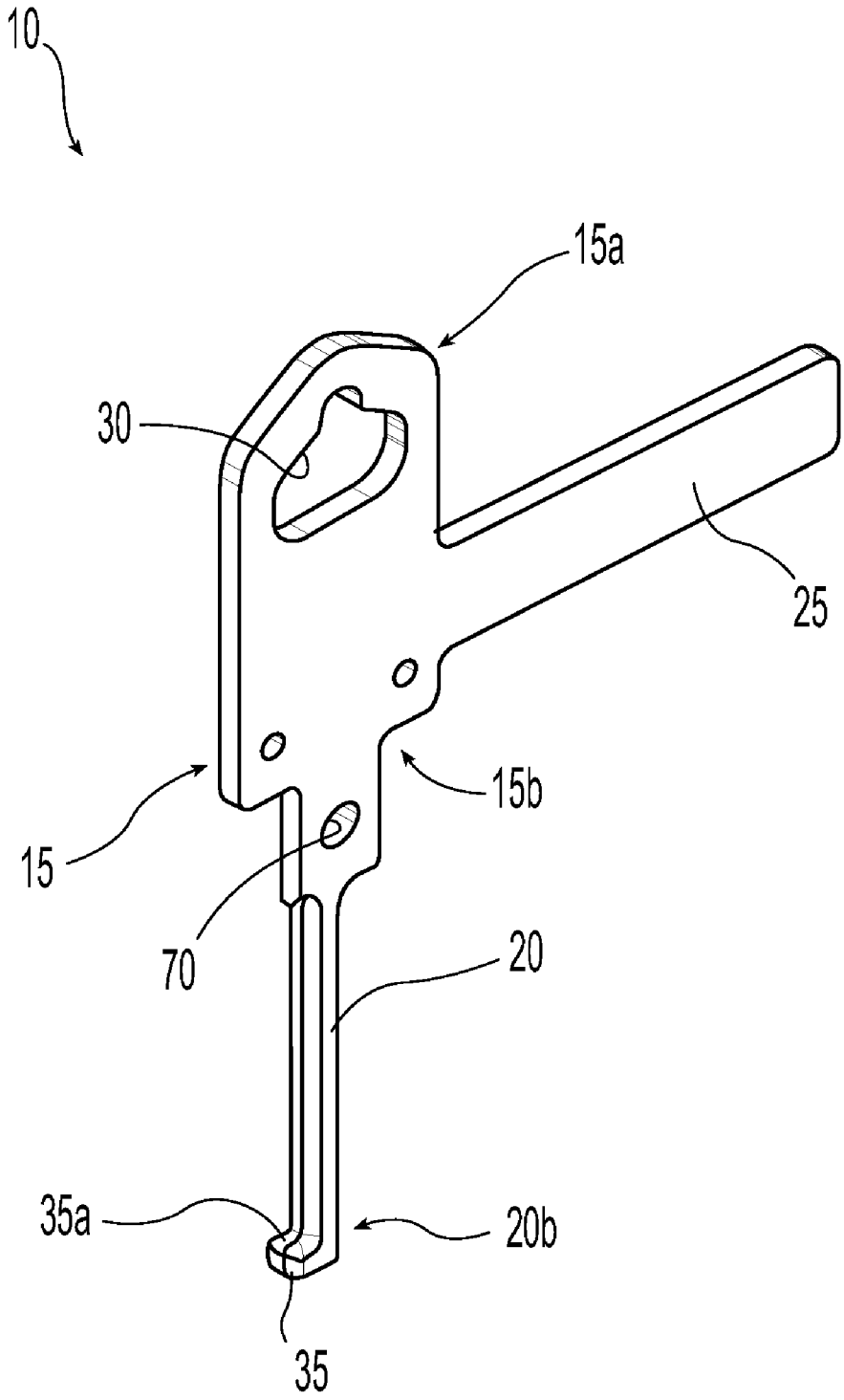
FIG. 2*a* is a perspective view of one member of the carrier device of FIGS. 1*a*-1*c;*
Figure 2B:
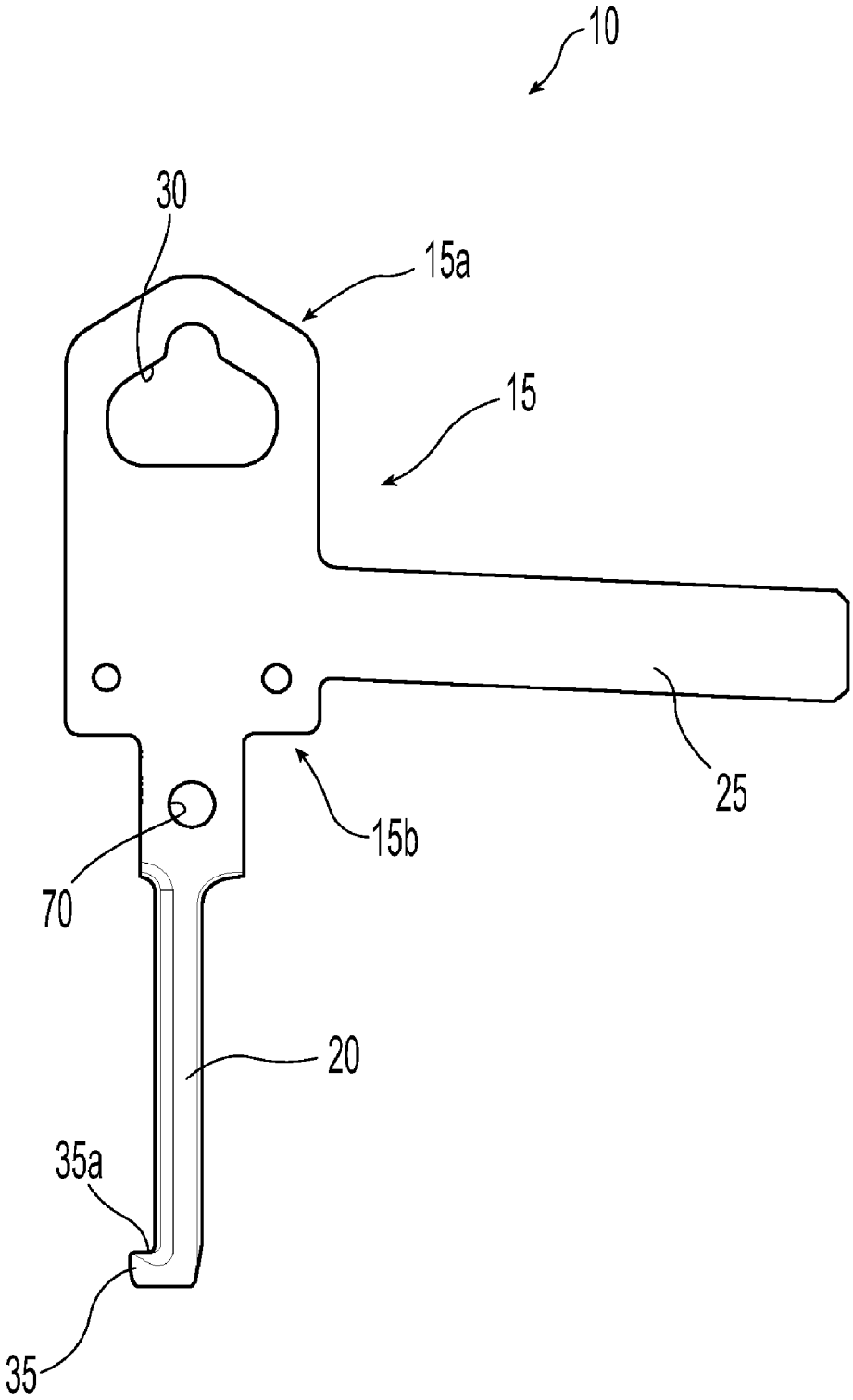
FIG. 2*b* is a right side view of the member of the carrier device shown in FIG. 2*a;*

The first member 10 of this embodiment of the carrier device 5 can be best observed in FIGS. 2*a*-2*b*, the term "first" being used only in a generically identifying sense and not as an indicator of order or importance. As shown, the first member 10 includes a body portion 15 having an elongate support leg 20 extending from a distal side 15*b* thereof. This particular embodiment of the first member 10 also has an optional handle 25 extending from the body portion 15 for facilitating manipulation of the carrier device 5 and rotation of the first member 10 with respect to the second member 40 (as described in more detail below). The handle 25 may extend at a slight angle from the body portion 15 so as to result in an assembled handle configuration similar to that illustrated in FIGS. 1*a*-1*c*, the operation of which is described in more detail below.

Preferably, an aperture 30 of some size and shape is provided near a proximal side 15*a* of the body portion 15 so as to allow the resulting carrier device 5 to be connected to a coupling or suspension element (see FIGS. 4-5) during use. Alternatively, the proximal side 15*a* of the body portion 15 may take the shape of a hook or other male coupling element, such as to be capable of engagement with the loop of a cable, etc.

A distal end 20*b* of the support leg 20 is provided with a at least one projection 35 or other structure that results in a generally hook-shaped element. Preferably, although not essentially, the projection 35 has a contact surface 35*a* that extends substantially transversely from the support leg 20.

Figure 3A:
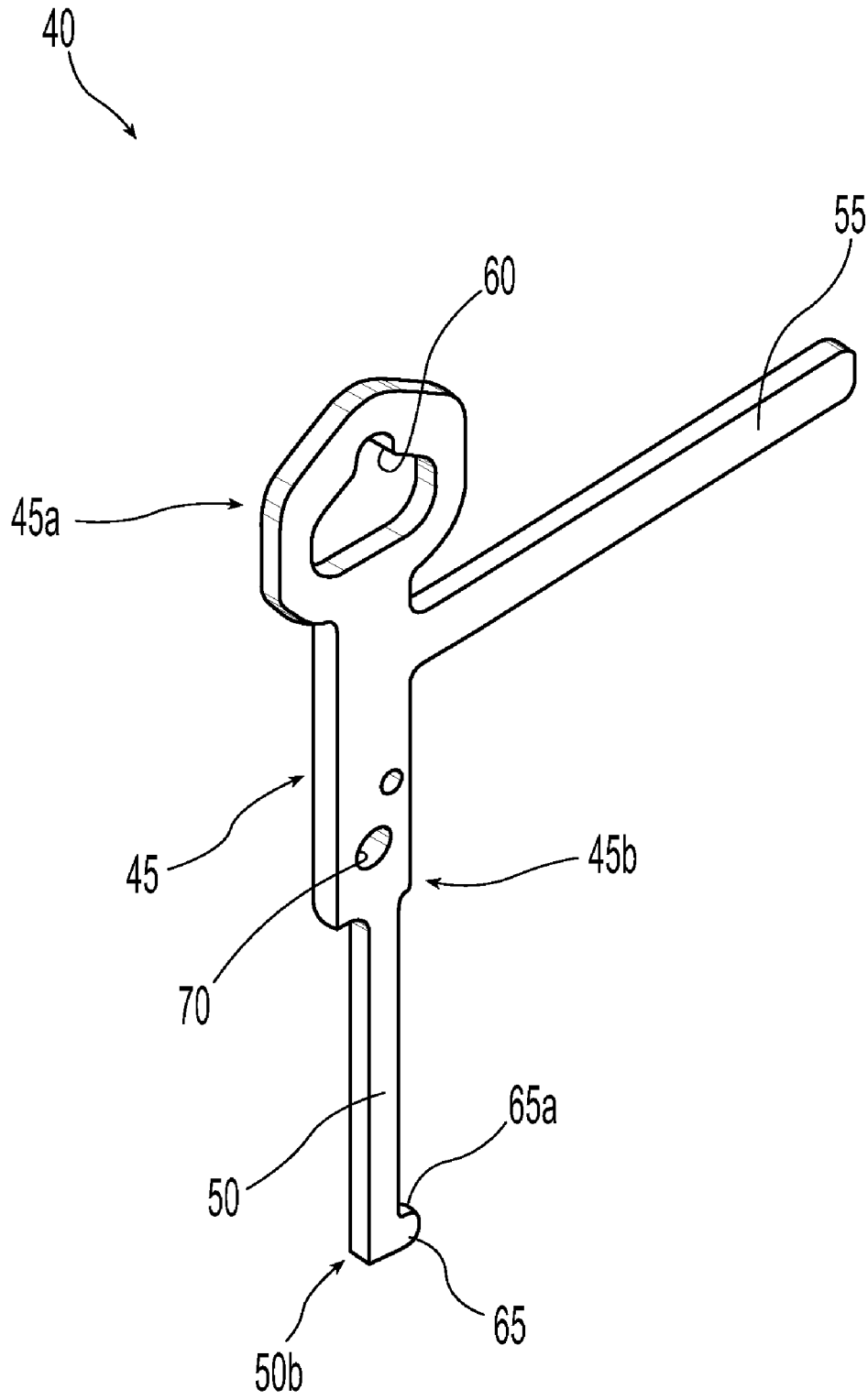
FIG. 3*a* is a perspective view of another member of the carrier device of FIGS. 1*a*-1*c;*
Figure 3B:
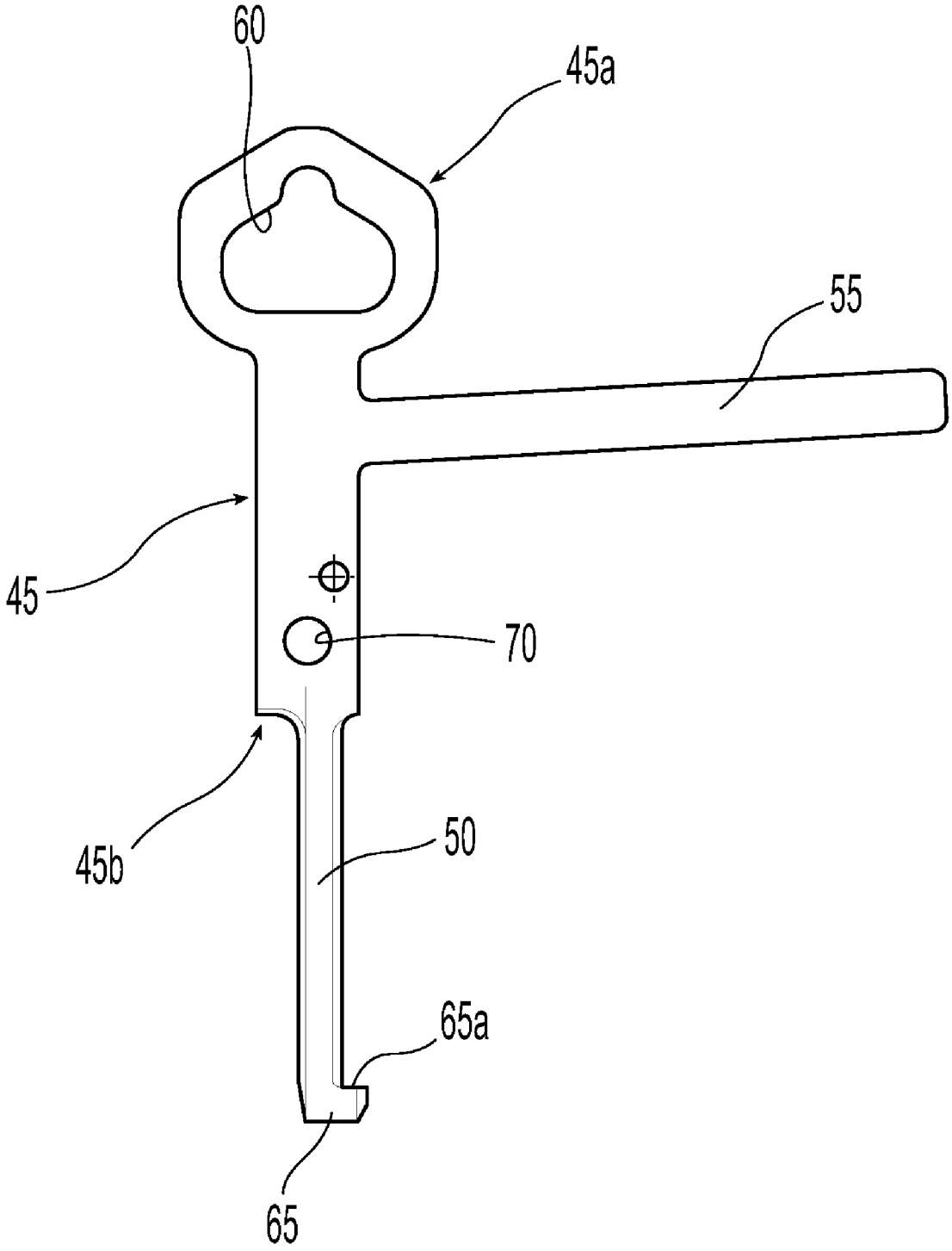
FIG. 3*b* is a right side view of the member of the carrier device shown in FIG. 3*a;*

The second member 40 of this embodiment of the carrier device 5 is shown in detail in FIGS. 3*a*-3*b*. As with the term "first," the term "second" is used herein only in a generically identifying sense and not as an indicator of order or importance. As shown, the second member 40 includes a body portion 45 having an elongate support leg 50 extending from one a distal side 45*b* thereof.

This particular embodiment of the first member 40 also has an optional handle 55 extending from the body portion 45 for facilitating manipulation of the carrier device 5 and rotation of the second member 40 with respect to the first member 10 (as described in more detail below). The handle 55 may extend at a slight angle from the body portion 45 so as to result in an assembled handle configuration similar to that illustrated in FIGS. 1*a*-1*c*, the operation of which is described in more detail below.

As with the first member 10, an aperture 60 of some size and shape may be provided near a proximal side 45*a* of the body portion 45 so as to allow the resulting carrier device 5 to be connected to a coupling or suspension element (see FIGS. 4-5) during use. The aperture 60 may be of a size and shape that is similar or dissimilar to the aperture 30 in the first member 10. Alternatively, the proximal side 45*a* of the body portion 45 may take the shape of a hook or other male coupling element, such as to be capable of engagement with the loop of a cable, etc. A distal end 50*b* of the support leg 50 is also provided with at least one projection 65 or other structure that results in a generally hook-shaped element. As with the projection 35 associated with the first support leg 20, the projection 65 preferably has a contact surface 65*a* that extends substantially transversely from the support leg.

Referring again to FIGS. 1*a*-1*c*, the carrier device 5 can be seen to include a rotatable assembly of the first and second members 10, 40. In this particular embodiment of the carrier device 5, attachment of the first member 10 to the second member 40 and the relative rotation therebetween is facilitated by a bolt (e.g., a shoulder bolt) and retaining nut assembly 75. The bolt passes through aligned holes 70 in each of the first and second members 10, 40 and acts as an axis of rotation therebetween. It should be understood that the holes 70 could be located at various points along the first and second members 10, 40, as long as the desired rotation therebetween can still be accomplished. One skilled in the art would also understand that there are other means by which to join the first and second members 10, 40 and to facilitate rotation therebetween, such as through use of a pressed-fit pin, for example.

Once the first and second members 10, 40 are properly assembled, it can be understood that relative rotation therebetween may occur along the shared central axis of the holes 70. In order to restrict the amount of such rotation and to urge the support legs 20, 50 toward a divergent rotational position, a biasing element 80 such as the illustrated spring is preferably employed. As can be best observed in FIG. 1*a*, one end of a spring is attached in this embodiment to each of the first and second members 10, 40 at a point above the axis of rotation thereof (e.g., above the holes 70). As such, when left in a static state, the spring will cause the support legs 20, 50 and their associated projections 35, 65 to move away from each other by some limited distance.

As described above, one or both of the handles 25, 55 may extend from its respective body portion 15, 45 at a slight angle. This preferably results in an assembled handle arrangement similar to that shown in FIGS. 1*a* and 1*c*. More specifically, the carrier device 5 is preferably provided with a handle arrangement whereby the gripping and squeezing thereof causes an alignment of the handles 25, 55 and a resulting rotation of the first and second members 10, 40 about their axis of rotation. This rotation also causes an inward movement of the respective support legs 20, 50 and their associated projections 35, 65. The result of such movement is an overlap of the support legs 20, 50 and projections 35, 65, which reduces the footprint presented by the projections and facilitates their passage through an opening in a vehicle rear suspension assembly. Once the handles 25, 55 are released, the support legs and associated projections will return to the biased position shown in FIGS. 1*a* and 1*c*.

Figure 4:
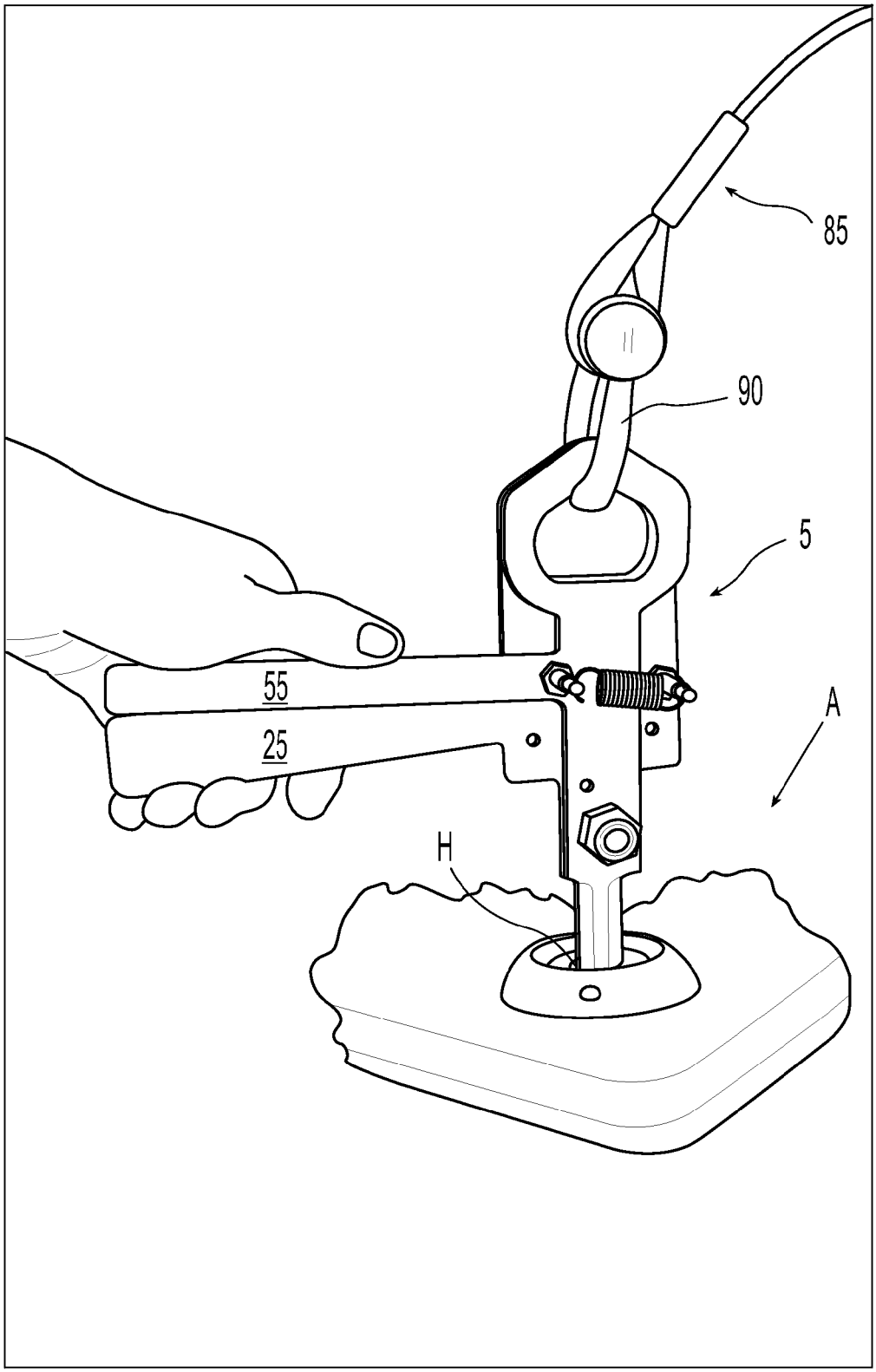
FIG. 4 shows a vehicle rear suspension assembly suspended by the carrier device of FIGS. 1*a*-1*c* and an associated cable.
Figure 5:
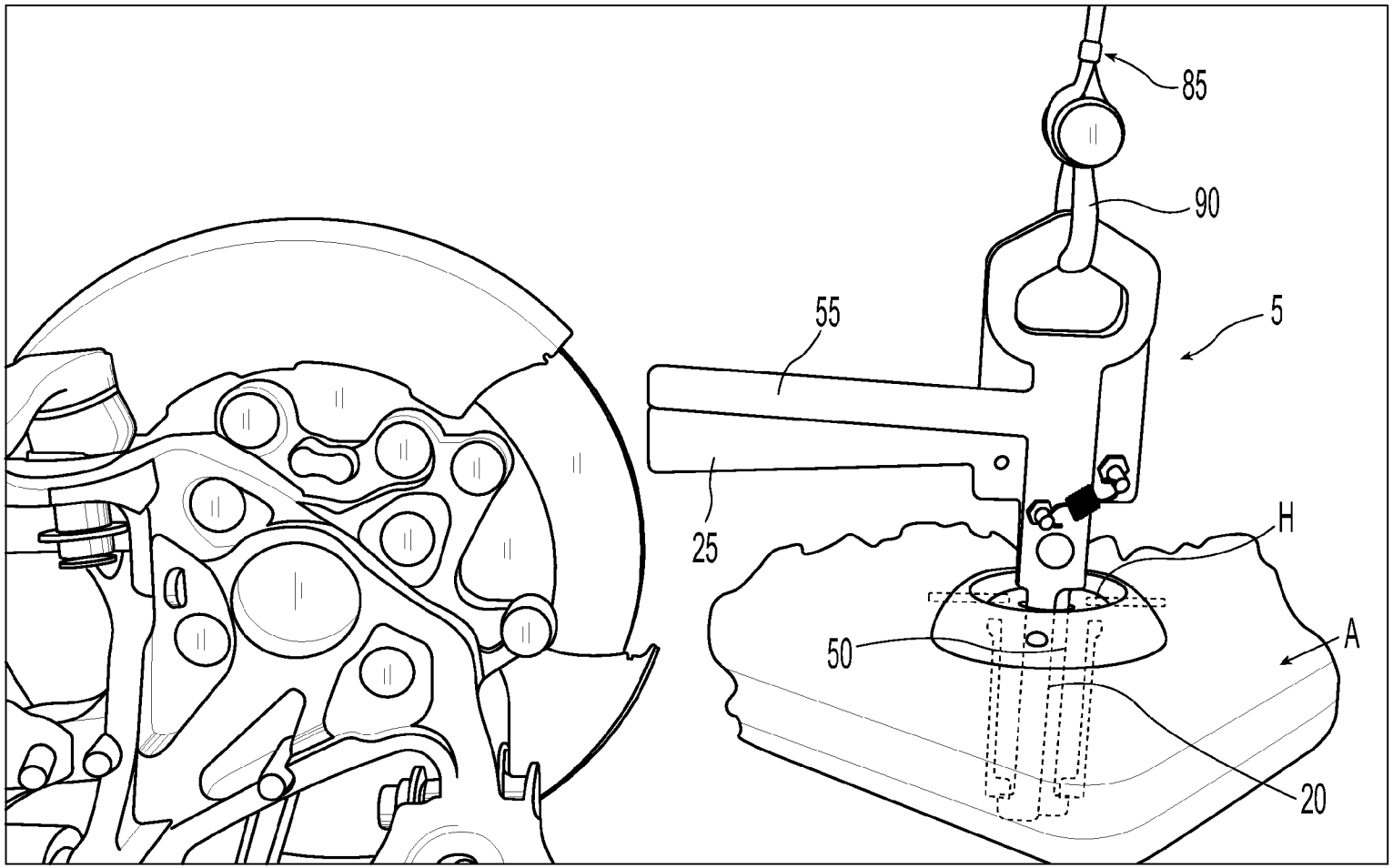
FIG. 5 depicts, in partial transparency, the carrier device of FIGS. 1*a*-1*c* inserted through an opening in a vehicle rear suspension assembly.

As shown in FIGS. 4-5, the carrier device 5 is suspended for use from a cable 85, chain or other suspension element. The suspension element may be connected to, for example, an overhead conveyor, gantry or other mechanism for effectuating suspended support and/or movement of a vehicle rear suspension assembly. In this particular embodiment, connection of the carrier device 5 to a cable 85, chain, etc., may be accomplished by attaching a lifting hook, shackle 90 or any of various other well known connecting elements to the cable or a link in a chain and passing the same through the openings 30, 60 in the first and second members 10, 40. Alternatively, and as described above, one or both of the first and second members 10, 40 may have a male connecting portion in the form of a hook, etc., formed therein or attached thereto. Other coupling arrangements are also possible, and virtually any coupling element or structure known to one skilled in the art may be used to connect the carrier device 5 to a cable, chain or other suspension element.

Figure 6A:
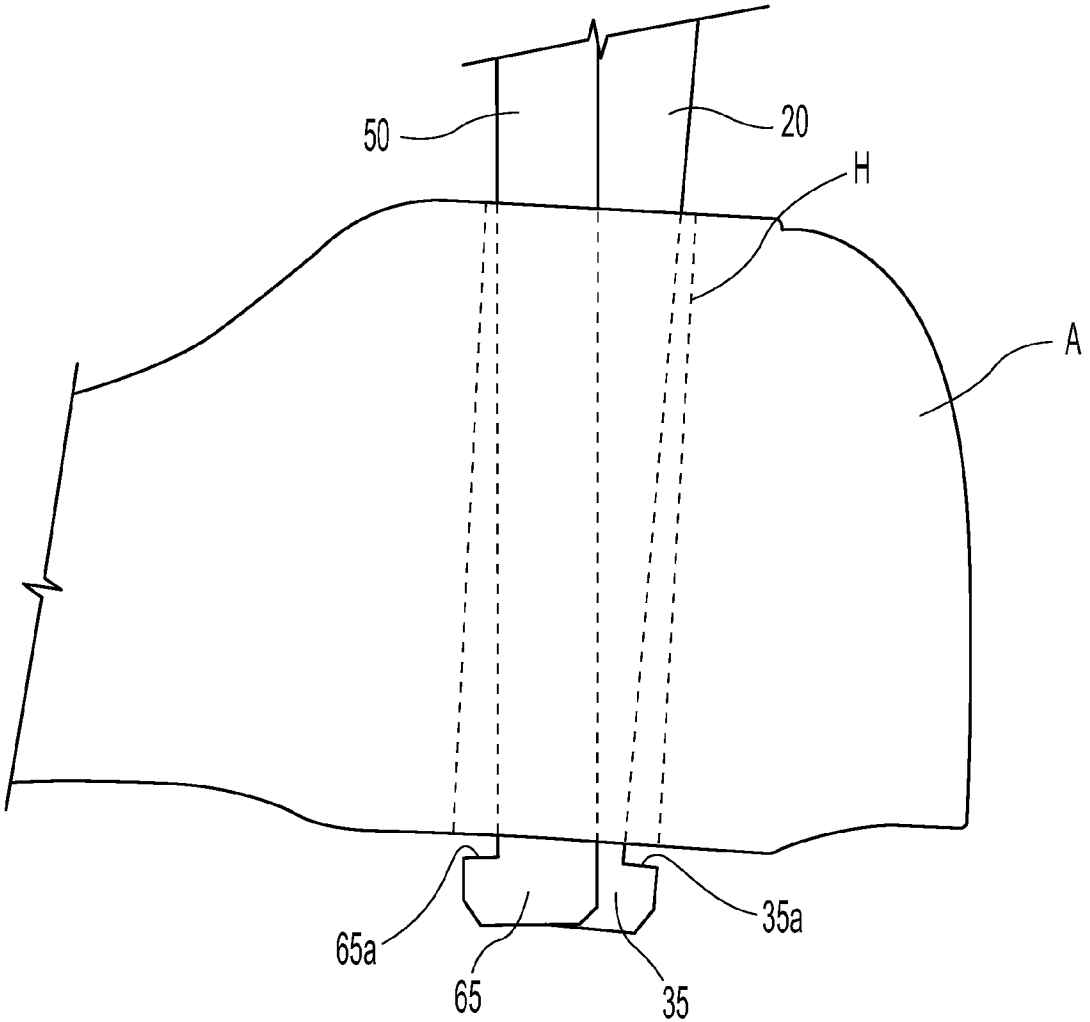
FIG. 6*a* illustrates how the support legs and associated projections of a device of the present invention can be pivoted inward to allow for insertion and withdrawal through an opening/hole in a vehicle rear suspension assembly.

As represented in FIG. 4, with the carrier device 5 appropriately suspended from a suspension element 85, an operator grasps and squeezes the handles 25, 55, thereby producing an inward scissor-like pivoting of the support legs 20, 50. As shown in FIG. 6*a*, this pivoting results in an overlapping arrangement of the projections 35, 65, which reduces the footprint thereof and facilitates passage of the projections and at least a portion of the support legs 20, 50 through an existing opening/hole H in a vehicle rear suspension assembly A.

In this particular illustrative embodiment, the opening H in the vehicle rear suspension assembly A is a preexisting mounting hole that will be used to mount the rear suspension assembly to the subframe of a vehicle. It should be realized by one skilled in the art, however, that various other openings/holes present in a vehicle rear suspension assembly may be used in conjunction with a carrier device of the present invention, and nothing herein is to be interpreted as limiting the present invention to the use of mounting hole like that shown.

Figure 6B:
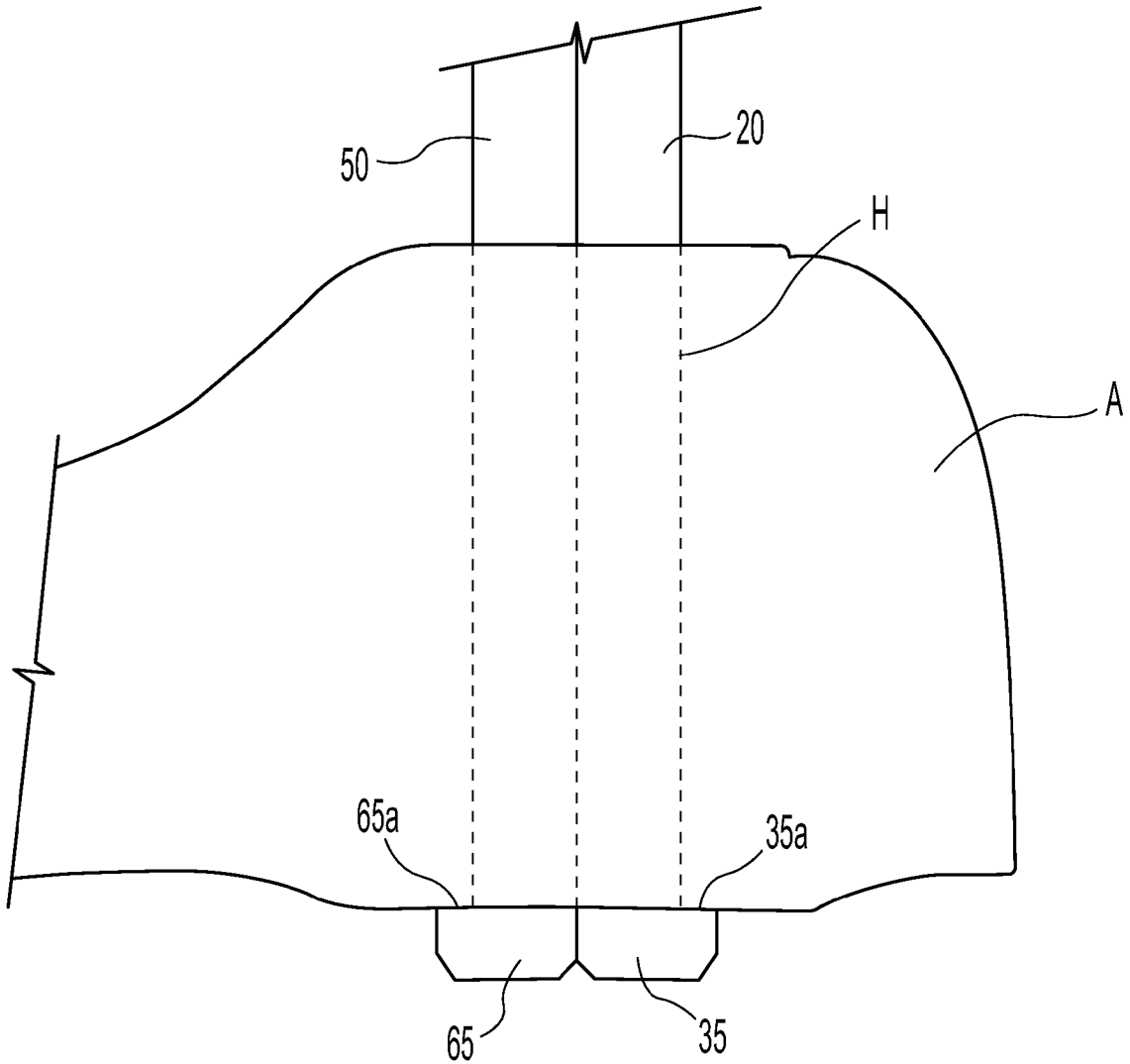
FIG. 6*b* illustrates how a vehicle rear suspension assembly is supported on projections that extend from support legs of a device of the present invention.

As illustrated in FIGS. 6*a*-6*b*, the support legs 20, 50 are inserted into the opening H until the projections 35, 65 exit the opposite side thereof. The inserted position of the carrier device 5 in the vehicle rear suspension assembly A can also be observed in the partially transparent view of FIG. 5. Once the projections 35, 65 have exited the opposite side of the opening H, the operator releases the handles 25, 55, which allows the support legs 20, 50 and their associated projections to move outward toward their normal biased positions. This results in at least a portion of each projection 35, 65 extending beyond the opening H and overlapping a portion of the rear suspension assembly structure as shown in FIG. 6*b*.

As can be best observed in FIG. 6*b*, with the projections 35, 65 protruding through the opening H therein, the adjacent structure of the vehicle rear suspension assembly A will rest on and be supported by the projection contact surfaces 35*a*, 65*a* when the vehicle rear suspension assembly is lifted. The outward bias of the support legs 20, 50 operates in conjunction with the downward force exerted by the vehicle rear suspension assembly A on the contact surfaces 35*a*, 65*a* to prevent an inward movement of the projections 35, 65 once the vehicle rear suspension assembly is placed in a suspended position.

It is to be understood that more than one carrier device 5 can be used to support a single vehicle rear suspension assembly. For example, two or more carrier devices 5 and associated suspension elements can be used to suspend and move the vehicle rear suspension assembly A of FIGS. 4-6. A lesser or greater number of carrier devices 5 may be employed, depending on the size, shape, weight, weight distribution and/or configuration of a particular vehicle rear suspension assembly of interest.

Once the carrier device(s) 5 is properly positioned within the opening(s) H, the vehicle rear suspension assembly A may be lifted, whereby it will be supported on the projections 35, 65 of each carrier device. When associated with a gantry, overhead conveyor or other motion imparting mechanism, the vehicle rear suspension assembly A may be moved about a work area, along an assembly line, etc., while in its suspended position.

Once the vehicle rear suspension assembly A is returned to a resting or otherwise supported position, the carrier device(s) 5 may be removed therefrom by once again squeezing the handles 25, 55 to overcome the biasing element 80 and cause an inward movement of the support legs 20, 50 and their associated projections 35, 65. This once again reduces the footprint presented by the projections 35, 65, thus allowing the projections to pass back through the opening H as the support legs 20, 50 of the carrier device 5 are withdrawn therefrom.

While certain embodiments of the present invention are described in detail above, the scope of the invention is not to be considered limited by such disclosure, and modifications are possible without departing from the spirit of the invention as evidenced by the following claims:

What is claimed is:

1. A carrier device for suspending a vehicle rear suspension assembly, comprising:

a first member having a body portion with an elongate support leg extending therefrom;

a second member having a body portion with an elongate support leg extending therefrom, said second member and said first member rotatably coupled near said body portions thereof so as to produce a scissoring movement of said support legs upon rotation;

a projection extending outwardly from each of said support legs;

a connecting element on/in a body portion of at least one of said members for coupling said device to a suspension element; and a handle extending from each of said first and second member;

wherein squeezing said handles results in an inward rotation of said support legs and associated projections, thereby facilitating passage of said projections through an opening in said vehicle rear suspension assembly; and wherein, said support legs are outwardly rotatable in order to subsequently engage a contacting surface of each projection with a portion of said vehicle rear suspension assembly structure adjacent to an opposite side of said opening.

2. The carrier device of claim 1, wherein said connecting element is an opening through at least one of said members.

3. The carrier device of claim 1, further comprising a biasing element for urging a limited outward rotation of said support legs and associated projections.

4. The carrier device of claim 3, wherein said biasing element is a spring connected between said first and second members.

5. The carrier device of claim 1, wherein said contacting surface of each projection extends substantially transversely from its corresponding support leg.

6. The carrier device of claim 1, wherein said first and second members are substantially flat plates of some shape.

7. A carrier device for suspending a vehicle rear suspension assembly through a preexisting opening therein, comprising:

a first plate member having a body portion with an elongate support leg extending from a distal end thereof;

a second plate member having a body portion with an elongate support leg extending from a distal end thereof, said second member and said first member rotatably coupled near said body portions thereof so as to produce a scissoring movement of said support legs upon rotation;

a projection extending oppositely outward from a distal end of each of said support legs, each projection having a contact surface;

a biasing element for urging a limited outward rotation of said support legs and associated projections;

a handle extending from each of said members, said handles adapted to partially overlap upon assembly of said members; and an aperture in said body portion of each of said members to allow for passage therethrough of a coupling device subsequent to assembly of said members;

wherein, by squeezing said handles, said support legs are inwardly rotated to facilitate passage of said projections through said opening in said vehicle rear suspension assembly; and wherein, by releasing said handles, said support legs are outwardly rotated by said biasing element to subsequently engage said contacting surface of each projection with a portion of said vehicle rear suspension assembly structure adjacent to an opposite side of said opening.

8. The carrier device of claim 7, wherein said handles extend from said first and second member at diverging angles.

9. The carrier device of claim 7, wherein said biasing element is a spring connected between said first and second members.

10. The carrier device of claim 7, wherein said contacting surface of each projection extends substantially transversely from its corresponding support leg.

* * * * *